US007900282B2

(12) United States Patent
Schuller

(10) Patent No.: US 7,900,282 B2
(45) Date of Patent: Mar. 8, 2011

(54) INFLATABLE PROTECTION VALVE

(75) Inventor: David Schuller, Casablanca (MA)

(73) Assignees: RXR Protect, Casablanca (MA); David Schuller, Le Menil Berard (FR)

( * ) Notice: Subject to any disclaimer, the term of this patent is extended or adjusted under 35 U.S.C. 154(b) by 64 days.

(21) Appl. No.: 12/159,857

(22) PCT Filed: Dec. 19, 2006

(86) PCT No.: PCT/MA2006/000006

§ 371 (c)(1),
(2), (4) Date: Jul. 10, 2008

(87) PCT Pub. No.: WO2007/078187

PCT Pub. Date: Jul. 12, 2007

(65) Prior Publication Data

US 2008/0313794 A1 Dec. 25, 2008

(30) Foreign Application Priority Data

Jan. 3, 2006 (MA) ..... 28691

(51) Int. Cl.
*A41D 13/05* (2006.01)
*A41D 13/015* (2006.01)
*A41D 13/00* (2006.01)

(52) U.S. Cl. ..... 2/455; 2/464; 2/92; 2/243.1

(58) Field of Classification Search ..... 2/455, 459, 2/460, 461, 462, 463, 464, 465, 466, 467, 2/92

See application file for complete search history.

(56) References Cited

U.S. PATENT DOCUMENTS

| | | | | | |
|---|---|---|---|---|---|
| 876,237 | A * | 1/1908 | Ridlon | 2/463 |
| 3,550,159 | A * | 12/1970 | Alarco | 2/463 |
| 3,945,042 | A * | 3/1976 | Lobo | 2/467 |
| 3,995,320 | A * | 12/1976 | Zafuto | 2/463 |
| 4,370,754 | A * | 2/1983 | Donzis | 2/463 |
| 4,397,636 | A * | 8/1983 | Ganshaw | 441/65 |
| 4,453,271 | A * | 6/1984 | Donzis | 2/456 |
| 4,566,137 | A * | 1/1986 | Gooding | 2/413 |
| 4,807,301 | A * | 2/1989 | Ferber | 2/465 |
| 4,900,377 | A * | 2/1990 | Redford et al. | 156/62.2 |
| 5,261,420 | A * | 11/1993 | Grillo | 5/655.9 |
| 5,423,087 | A * | 6/1995 | Krent et al. | 2/463 |
| 5,545,128 | A * | 8/1996 | Hayes et al. | 602/61 |
| 5,599,290 | A * | 2/1997 | Hayes et al. | 602/61 |
| 6,093,468 | A * | 7/2000 | Toms et al. | 428/67 |
| 6,460,541 | B1 * | 10/2002 | Shah et al. | 128/845 |
| 6,564,387 | B1 * | 5/2003 | Willoughby | 2/69 |
| 6,796,865 | B2 * | 9/2004 | Raithel et al. | 441/106 |
| 2006/0010588 | A1 * | 1/2006 | Schuster et al. | 2/455 |
| 2007/0199124 | A1 * | 8/2007 | Horn | 2/69 |
| 2007/0214552 | A1 * | 9/2007 | Ferber | 2/465 |
| 2009/0241968 | A1 * | 10/2009 | Murphy et al. | 128/846 |

FOREIGN PATENT DOCUMENTS

FR 2507064 A 12/1982

OTHER PUBLICATIONS

International Search Report dated May 31, 2007 for PCT/MA2006/000006.

* cited by examiner

*Primary Examiner* — Bobby H Muromoto, Jr.
(74) *Attorney, Agent, or Firm* — Pearne & Gordon LLP

(57) ABSTRACT

A device for protecting against impact. The device includes an inflatable valve made of sheets of high-strength PVC (1) provided with an inflating end (3). Fitted within this valve using a method of thermal bonding (4) are walls (2) configured as a labyrinth in order to better regulate the air flow.

6 Claims, 2 Drawing Sheets

FIG.A
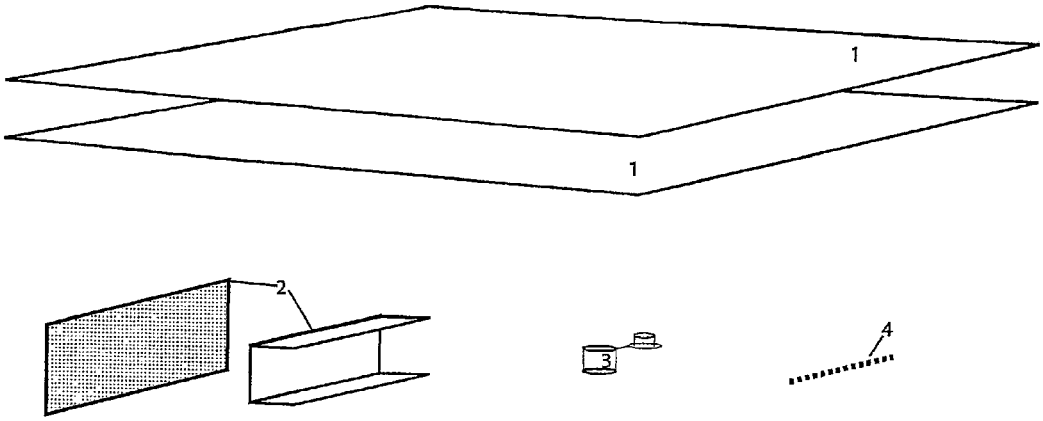
FIG.B
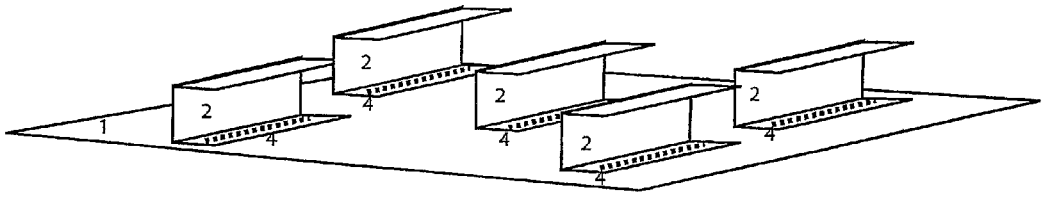
FIG.C
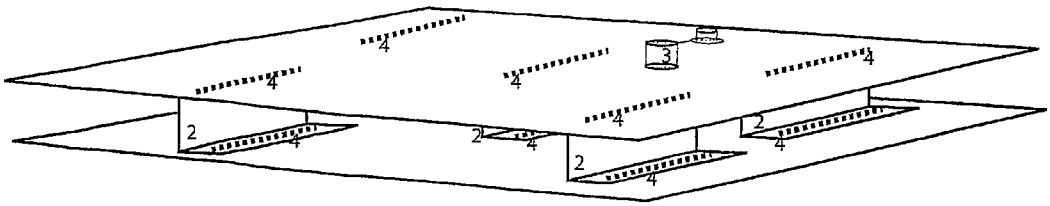

FIG.D
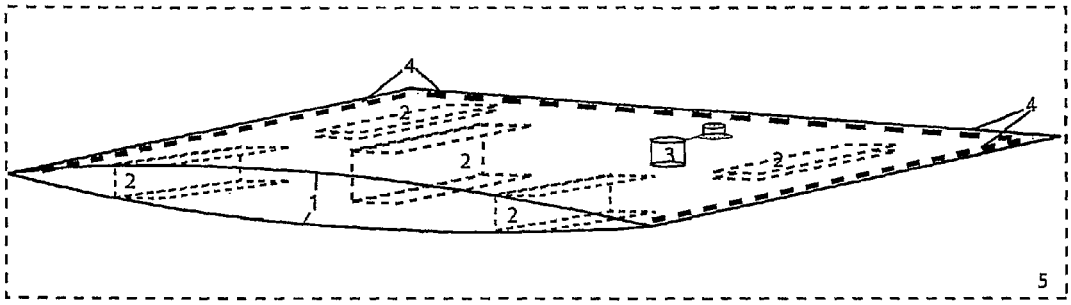
FIG.E
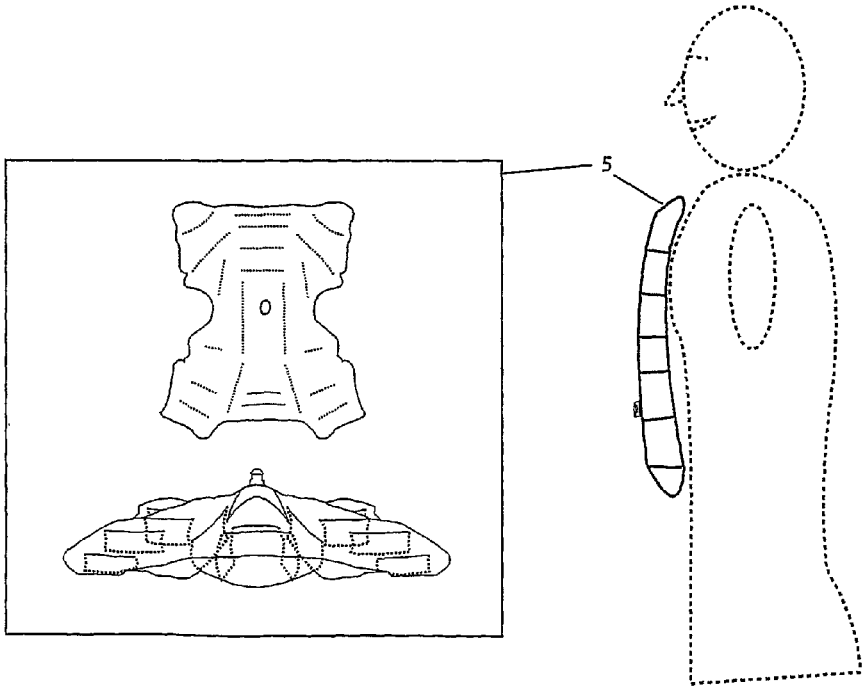

INFLATABLE PROTECTION VALVE

The present invention relates to a system of inflatable valves for protecting the body in case of a fall or of impact.

Protection is traditionally made of rigid plastic or foam, without any real ability to absorb shocks or impacts.

The device according to the invention makes it possible to remedy this disadvantage. It comprises according to a first characteristic a valve that can be inflated by means of an inflating end. Once inflated, it is applied to the body part that is to be protected.

U.S. Pat. No. 3,550,159 describes an inflatable structure to protect a person's torso against impact. This structure has, in its thickness, three layers of cells communicating between one another by small air passageways provided in their walls. This structure being thick, it is uncomfortable and inconvenient, for example for motorcyclists or sportsmen who must not be hindered in their movements by their protective clothing. Furthermore, the cells are almost completely closed and only have small air passageways between them. In case of sudden and violent impact, their air is thus congested and blocked in its cell and cannot circulate correctly from one cell to another to absorb the impact efficiently.

U.S. Pat. No. 876,237 describes a torso protection having two independent air chambers placed side by side and each divided into compartments with small air passageways between them. This protection structure thus suffers the same defects of shock absorption as the one described previously, heightened by the fact that the two air chambers do not communicate with one another.

U.S. Pat. No. 3,995,320 describes an inflatable protection structure having a single air chamber. The chamber is formed by two plastic panels bonded together at their periphery. The air chamber is divided into compartments, also by bonding together upper and lower panels. Small air passageways are provided between the compartments. These passageways however do not allow the air to move fast inside the air chamber in case of a sudden and violent impact. Furthermore, the protective effect of the structure is further reduced by its design itself, in particular because of the fact that the upper panel is directly bonded to the lower panel in several places of the structure. Indeed, an impact close to these places would be not at all or only slightly reduced, since there is no or only little air between the two panels in these places and at their periphery.

Document FR 2 507 064 describes an inflatable lining for clothing providing insulation against cold and humidity. It is briefly mentioned that this lining can protect against impact. The means allowing such a protection are however absolutely not described. The function of the spacers mentioned in this document is solely to maintain a certain distance between the walls of the lining and their shape is not specified.

One aim of the present invention is thus to offer an inflatable protection valve affording protection against impact that is more efficient than the protection afforded by the prior art valves.

According to specific embodiments:

The valve is made of high-strength PVC consisting of two parts joined together by thermal bonding.

Inside the valve are walls, at a distance from one another.

The walls are made of flexible high-strength PVC and are fitted to the valve by thermal bonding.

The walls are configured as a labyrinth in order to allow the air to circulate. When the air circulates gently, the valve remains flexible, but in case of impact, the air is blocked.

The attached drawings illustrate the invention:

FIG. A illustrates the different parts of the valve.

FIG. B represents a cross section of the first manufacturing step, the thermal bonding of the walls on the lower part of the valve.

FIG. C represents a cross section of the second manufacturing step, the thermal bonding of the walls on the upper part of the valve.

FIG. D represents a cross section of the last step, which consists in joining by thermal bonding the valve's upper part to its lower part, on their edge.

FIG. E represents the valve placed by way of example of a location on a human body.

By reference to these drawings, the invention comprises flexible high-strength PVC sheets 1 onto which walls of flexible high-resistance PVC 2 and an inflating end 3 are fitted by thermal bonding to achieve a valve 5.

The sizes of the walls 2 are adapted according to the size and air volume of the valve. Their spacing is different according to the expected effect. The closer together they are, the more the impact will be absorbed.

By way of example, the valve illustrated in FIG. E will have dimensions of approximately 30 cm by 40 cm. And the walls in FIG. A will have dimensions of 10 cm by 3 cm, at a distance of 1 cm.

FIG. A illustrates the elements constituting the inflatable protection valve according to an embodiment of the invention. These are two PVC sheets 1, two PVC walls 2, one of the walls 2 being folded on two of its extremities, an inflating end 3 and a dotted line representing a thermal bonding 4.

FIG. B shows one of the two PVC sheets 1 onto which PVC walls 2 have been fitted by thermal bonding on one of their extremities.

FIG. C shows the second PVC sheet 1 placed opposite the first PVC sheet 1 and assembled to the elements of FIG. B by thermal bonding 4 on the other extremity of each of the walls 2. The second PVC sheet 1 comprises the inflating end 3.

FIG. D illustrates the last manufacturing step of the inflatable valve 5, where the two PVC sheets 1 are thermally bonded to one another on their periphery to close off the air chamber of the inflatable valve 5 of the invention.

FIG. E shows an inflatable valve 5 according to the invention adapted to the protection of the torso of a human being. The inflatable valve 5 has an ergonomic shape adapted to its function. The walls inside the inflatable valve 5 are arrayed according to a specific layout to achieve the sought protective effect. The walls are arranged along different axes forming acute angles between at least some of them. The space between the walls is sufficient to allow air to circulate around each wall. The walls do not form compartments.

According to what is visible in FIGS. A to E and to what has been described here above, the inflatable protection valve 5 of the invention comprises a single air chamber and an adapter 3 for inflating the air chamber. The valve 5 has a lower part constituted of a flexible high-strength PVC sheet 1 and an upper part constituted of a flexible high-strength PVC sheet 1. The upper part and the lower part are joined to one another on their edge by thermal bonding. The valve 5 further comprises a plurality of walls 2 of flexible high-strength PVC placed inside the air chamber and fitted by thermal bonding on the one hand to the upper part and on the other hand to the lower part. The walls 2 are at a distance from one another to allow air to circulate between them when the valve 5 is inflated.

According to a preferred embodiment, the protective inflatable valve comprises high-strength PVC sheets 1 and an inflating end 3. The sheets 1 are joined to one another by thermal bonding 4 to form an enclosure of small thickness capable, after inflation, of protecting efficiently body parts from shocks and impacts.

Walls 2 are fitted between the high-strength PVC sheets 1 by thermal bonding 4. The walls are configured as a labyrinth in order to better regulate the air flow in case of shock or impact.

By modifying the size of the valve 5 and the size of the walls 2, it is possible to achieve different levels of protection on different parts of the body.

The valve can be used, by way of non-limiting example, in action sports.

The invention claimed is:

1. An inflatable protective device to be worn by a user as a garment for the protection of a torso of the user against shocks and impacts, the device includes:

a first, flexible high-strength PVC sheet having a perimeter edge;

a second, flexible high-strength PVC sheet having a perimeter edge; the first and second sheets being thermally bonded together at their perimeter edges to entrap a volume of air and enclose a single air chamber, the device only having the single air chamber and not having more air chambers than the single air chamber, the first and second sheets defining the outer boundary of the single air chamber with each of the first and second sheets having an exterior side facing the external ambient atmosphere and an interior side facing the air chamber;

a inflating adaptor end located on one of the first and second sheets for permitting air flow into the single air chamber for entrapment of the volume of air within the single air chamber, the entrapped air can only pass through the inflating adaptor end and cannot otherwise pass through the first and second sheets to effect the entrapment, and the entrapment of the volume of air provides for the chamber to filled with air and not filled with non-air material; and a plurality of walls of flexible high-strength PVC material located completely within the single air chamber bounded by the first and second sheets and exposed only to the air that is entrapped within the single air chamber and not exposed to the external ambient atmosphere, each wall is a separate member from the first and second sheets, each wall having a first portion thermally bonded to the interior side of the first sheet and a second portion thermally bonded to the interior side of the second sheet, each of the walls is sized so has to not extend to bisect the single air chamber into multiple air chambers and to permit flow of the entrapped air within the single air chamber past the respective wall.

2. A device as set forth in claim 1, wherein the air chamber is not filled with a foam material.

3. A device as set forth in claim 1, wherein the air chamber is not filled with a resilient polymer-based material.

4. A device as set forth in claim 1, wherein the air chamber is not filled with a rubber-based material.

5. A device as set forth in claim 1, wherein the first and second sheets are sized and shaped to correspond to the shape of the torso of the user.

6. A device as set forth in claim 1, wherein each of the plurality of wall has folds such that the first and second portions t thermally bonded to the interior sides of the first and second sheets, respectively, are transverse to a portion of the wall extending between the interior side of the first and second sheets to provide a baffle completely within the air chamber that impedes air movement of the air flow of the entrapped air within the air chamber.

* * * * *